US010573263B2

(12) United States Patent
Fukute et al.

(10) Patent No.: US 10,573,263 B2
(45) Date of Patent: Feb. 25, 2020

(54) DRIVER IC AND ELECTRONIC APPARATUS

(71) Applicant: Synaptics Japan GK, Tokyo (JP)

(72) Inventors: Akiko Fukute, Tokyo (JP); Koji Tokura, Tokyo (JP); Shigeo Hattori, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 323 days.

(21) Appl. No.: 15/138,743

(22) Filed: Apr. 26, 2016

(65) Prior Publication Data

US 2016/0322013 A1 Nov. 3, 2016

(30) Foreign Application Priority Data

Apr. 28, 2015 (JP) ..... 2015-091167

(51) Int. Cl.
*G09G 3/36* (2006.01)

(52) U.S. Cl.
CPC ... *G09G 3/3648* (2013.01); *G09G 2300/0426* (2013.01); *G09G 2330/12* (2013.01)

(58) Field of Classification Search
None
See application file for complete search history.

(56) References Cited

U.S. PATENT DOCUMENTS 6,266,095 B1 * 7/2001 Sunwoo ..... G06T 3/40 348/473
7,103,029 B1 * 9/2006 Minowa ..... H03G 3/3042 370/249
2008/0136756 A1 * 6/2008 Yeo ..... G09G 3/3677 345/87
2011/0199397 A1 * 8/2011 Ko ..... G09G 3/3688 345/690
2012/0257132 A1 10/2012 Kitajima et al.
2016/0064424 A1 * 3/2016 Umezaki ..... H01L 29/7869 257/43

* cited by examiner

*Primary Examiner* — William Boddie
*Assistant Examiner* — Jeffrey Parker
(74) *Attorney, Agent, or Firm* — Patterson + Sheridan, LLP

(57) ABSTRACT

A driver IC is described by which disconnection can be readily prevented from being falsely determined even on condition that an input voltage fed back as a result of output of a detecting voltage by a driver IC is affected by noise on a driven device. The driver IC is arranged so that the latch timing of latching a result of the comparison between an input voltage fed back as a result of a detecting voltage output by the driver IC and the detecting voltage is shift-controlled in each predetermined cycle of synchronizing signals with a predetermined shift and even if noise is generated in a driven device at any time in each cycle of the synchronizing signals, determination signals affected by the noise are never latched in each cycle of the synchronizing signals.

20 Claims, 7 Drawing Sheets

DRIVER IC AND ELECTRONIC APPARATUS

CROSS-REFERENCE TO RELATED APPLICATIONS

The present application claims priority to Japanese application JP 2015-091167, filed on Apr. 28, 2015, the content of which is hereby incorporated by reference into this application.

FIELD OF THE INVENTION

The present invention relates to a driver IC having the function of detecting a broken wire in a driven device to be driven, which can be applied as e.g. an LC display driver for display driving of a liquid crystal (LC) display panel, and it relates to a technique useful in application to detection of a broken glass substrate in an LC display panel and the like.

BACKGROUND

The function of detecting a broken glass substrate in an LC display panel("Display Glass Broken Detect function") has been described in Japanese Unexamined Patent Application Publication No. JP-A-2012-220792. According to JP-A-2012-220792, a disconnection-detecting metal line is formed around a glass substrate (thin-film transistor (TFT) substrate) of an LC display panel having an LC display part formed in a center portion thereof. The disconnection of the disconnection-detecting metal line can be detected by checking the electrical continuity of the metal line through a pair of external terminals to which the metal line is connected during a manufacturing process. In case that the disconnection is detected, a crack reaching an LC display region is regarded as being formed in the glass substrate. In the case of an LC display driver supporting the detection of disconnection by use of a disconnection-detecting metal line as described above, the LC display driver outputs a predetermined voltage signal to the disconnection-detecting metal line, accepts the input of a voltage signal fed back through the disconnection-detecting metal line, and uses a comparator to make determination on whether or not a difference equal to or larger than an allowable voltage is caused between the voltage signals. On condition that the difference remains equal to or larger than the allowable voltage for a fixed period of time, the LC display driver determines that disconnection has occurred, i.e., a crack is formed.

SUMMARY

In an embodiment, a driver integrated circuit (IC) includes driving circuits operable to periodically output drive signals to a driven device in synchronization with synchronizing signals. The driver IC further includes a detection circuit operable to detect a disconnection in the driven device. The detection circuit includes: a determination circuit configured to determine whether an input voltage fed back to an input terminal as a result of output of a detecting voltage from an output terminal is in an expected voltage relation with the detecting voltage; a latch circuit configured to latch a result of determination by the determination circuit; an abnormality counter operable to count up periods for which results of the determination latched by the latch circuit in a row represent that the input voltage is out of the expected voltage relation, and arranged so that its count value is initialized in case that a result of the determination represents that the input voltage is in the expected voltage relation. The driver IC includes a timing controller operable to shift-control a latch timing of the latch circuit to latch in each predetermined cycle of the synchronizing signals with a predetermined shift.

In another embodiment, an electronic apparatus includes a driver integrated circuit (IC); and a driven device driven by the driver IC. The driven device includes a disconnection-detecting line. The driver IC includes driving circuits operable to periodically output drive signals to the driven device in synchronization with synchronizing signals, and a detection circuit operable to detect disconnection in the disconnection-detecting line of the driven device. The detection circuit includes a determination circuit operable to output a detecting voltage from an output terminal connected to one end of the disconnection-detecting line, and to determine whether an input voltage fed back to an input terminal connected to the other end of the disconnection-detecting line as a result of the output of the detecting voltage is in an expected voltage relation with the detecting voltage. The detection circuit further includes a latch circuit operable to latch a result of the determination by the determination circuit, an abnormality counter operable to count periods for which results of the determination latched by the latch circuit in a row represent that the input voltage is out of the expected voltage relation, and arranged so that its count value is initialized in case that a result of the determination represents that the input voltage is in the expected voltage relation. The apparatus further includes a timing controller operable to shift-control a latch timing of the latch circuit to latch in each predetermined cycle of the synchronizing signals with a predetermined shift.

DETAILED DESCRIPTION

Figure 1:
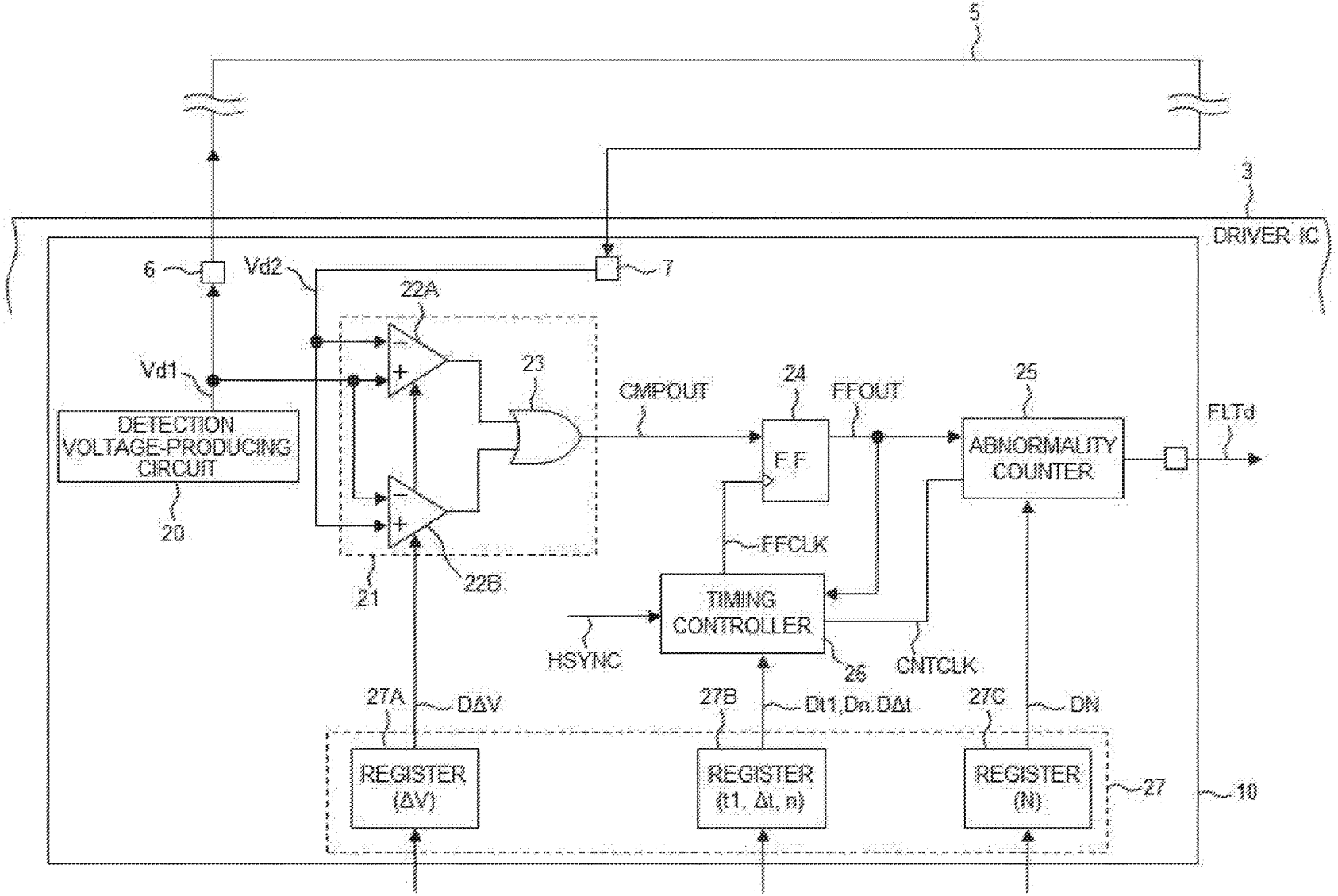
FIG. 1 is a block diagram showing an embodiment of a disconnection-detecting circuit.

The inventor examined such a display driver having the function of detecting a disconnection as disclosed in JP-A-2012-220792.

Such a display driver activates, by use of drive signals, relatively large loads such as gate and source electrode lines of a liquid crystal panel while synchronizing to a display timing. The change in such drive signals provides a cross talk noise or the like to the disconnection-detecting metal line located in the vicinity of the drive signal lines. This can undesirably change the level of signals input from the disconnection-detecting metal line to the comparator. The coincidence between the timing of signal acquisition from the disconnection-detecting metal line and the timing of noise generation causes the difference between the two kinds of voltage signals input to the comparator to remain the allowable voltage or larger for a fixed period of time. Thus, disconnection can be falsely determined. Even if an attempt to detect occurrence of a crack is made by acquiring outputs of the comparator more than once during a fixed period of time in order to avoid a false detection attributed to noise, the risk of false detection of disconnection cannot be eliminated as long as the timing of acquiring outputs of the comparator is fixed. In particular, the timing of the change in each of gate and source drive signals output by the display driver is varied depending on a panel size and the like. Therefore, it is difficult to correctly predict the timing of generation of noise on a display panel.

In an embodiment, a driver IC is provided by which disconnection can be readily prevented from being falsely determined even on condition that an input voltage fed back as a result of output of a detecting voltage by a driver IC is affected by noise on a driven device.

Various embodiments of the invention and novel features thereof will become apparent from the description hereof and the accompanying diagrams.

Of the embodiments herein disclosed, the representative embodiment is briefly outlined below. It is noted that the reference numerals and others for reference in the diagrams, which are put in round brackets in the respective items, are just examples for easier understanding.

[1] Driver IC

The driver IC (3) has: driving circuits (17, 18) operable to periodically output drive signals to a driven device (4) in synchronization with synchronizing signals (HSYNC); and a detection circuit (10) operable to detect a disconnection in a driven device. The detection circuit has: a determination circuit (21) that determines whether or not an input voltage (Vd2) fed back to an input terminal (7) as a result of output of a detecting voltage (Vd1) from an output terminal (6) is in an expected voltage relation with the detecting voltage; a latch circuit (24) that latches a result of determination by the determination circuit; an abnormality counter (25) operable to count up periods for which results of the determination latched by the latch circuit in a row represent that the input voltage is out of the expected voltage relation, and arranged so that its count value is initialized in case that a result of the determination represents that the input voltage is in the expected voltage relation; and a timing controller (26) operable to shift-control a latch timing of the latch circuit to latch in each predetermined cycle of the synchronizing signals with a predetermined shift.

According to the arrangement described above, the latch timing of latching a result of comparison between an input voltage fed back as a result of output by the driver IC and a detecting voltage is shift-controlled with a predetermined shift in each predetermined cycle of the synchronizing signals. Therefore, even if noise is generated in a driven device with any timing in each cycle of the synchronizing signals, a determination signal affected by the noise is never latched in each cycle of the synchronizing signals. As such, the latched result of the determination is prevented from being pushed out of the expected voltage relation over each cycle of the synchronizing signals. The disconnection can be prevented from being falsely determined even on condition that an input voltage fed back as a result of output of a detecting voltage by a driver IC is influenced by noise on a driven device. The timing of latching a result of the determination by the latch circuit is shift-controlled with a predetermined shift by the timing controller in each predetermined cycle of the synchronizing signals, which prevents false determination of disconnection. In other words, the false detection of disconnection can be avoided readily and automatically.

[2] Allowable Voltage ΔV

In the item [1] above, the expected voltage relation is one in which an absolute value voltage of difference between the detecting voltage and the input voltage is within an allowable voltage (referred to as ΔV). The determination circuit determines, based on allowable voltage data (DΔV) overwritably set on a memory circuit, whether or not the input voltage is in the expected voltage relation with the detecting voltage.

According to such an arrangement, the expected voltage relation can be decided depending on the kind of noise or the size thereof. In addition, it is possible to cope with the change in polarity of noise.

[3] Unit Shift Δt

In the item [1] above, the timing controller decides a predetermined shift of the shift control based on unit shift data (DΔt) overwritably set on the memory circuit.

According to such an arrangement, in case that the determination circuit acquires the state of noise, subsequent timings of acquisition can be automatically shifted in unit shifts depending on unit shift data in turn and the unit shift can be appropriately elongated. Therefore, even in a case such that the timing of noise generation in cycles of synchronizing signals take various forms, it can be readily avoided that the latch circuit latches the influence of the noise every time.

[4] Latch Offset t1

In the item [1] above, the timing controller decides a first latch timing of latching, by the latch circuit, a result of determination by the determination circuit according to latch offset data (Dt1) overwritably set on the memory circuit.

According to such an arrangement, the timing of first acquiring, into the latch circuit, a result of the determination by the determination circuit can be desirably set within each cycle of synchronizing signals. Therefore, it becomes easier to desirably decide the latch timing of the latch circuit.

[5] Limit Value N

In the item [1] above, the abnormality counter outputs an abnormality signal (referred to as FLTd) on its count value reaching a value of limit value data (DN) overwritably set on the memory circuit.

According to such an arrangement, it is possible to appropriately decide a limit value to determine whether the count value of the abnormality counter represents the disconnection or represents the accumulation of results of false determination of the noise influence. Therefore, the detection of disconnection can be automatically performed according to characteristics of a driven device and a driver IC. Incidentally, the presence or absence of disconnection may be determined by making reference to the count value of the abnormality counter outside the driver IC.

[6] Number n of Synchronizations

In the item [1] above, the timing controller has a synchronization counter (30) operable to count up changes in synchronization with the synchronizing signals; and a subsequent latch timing of the latch circuit is restored to its initial timing on condition that the number of synchronizations counted up by the synchronization counter coincides with a number indicated by number-of-synchronizations data (Dn) overwritably set on the memory circuit.

According to such an arrangement, the action of repeating, in a wrap-around manner, a round of the action of shifting the latch timing of the latch circuit 24 at intervals of more than one cycle of synchronizing signals is readily materialized.

[7] Counting of Count Pulses in Synchronization with the Latch Timing of the Latch Circuit In the item [1] above, the abnormality counter counts up count pulses (CNTCLK) on condition that the result of the determination represents that the input voltage is out of the expected voltage relation. The count pulses are signals subjected to pulse change in synchronization with the latch timing of the latch circuit, and the timing controller outputs the count pulses.

According to such an arrangement, count pulses to be counted by the abnormality counter can be produced readily.

[8] Control for Shifting the Latch Timing in Each Cycle of Synchronizing Signal

In the item [7] above, the timing controller performs the shift control of the latch timing in each cycle of the synchronizing signals.

According to such an arrangement, the timing control that enables the prevention of the false detection of disconnection is made easier. The shift control of the latch timing is not limited to this. It is obvious that the shift control may be performed at intervals of a plurality of cycles of synchronizing signals or a fraction of the cycle.

[9] Electronic Apparatus

In an embodiment, the electronic apparatus (1) includes: a driver IC(3); and a driven device (4) driven by the driver IC. The driven device has a disconnection-detecting line (5). The driver IC includes: driving circuits operable to periodically output drive signals to the driven device in synchronization with synchronizing signals; and a detection circuit operable to detect disconnection in the disconnection-detecting line of the driven device. The detection circuit includes: a determination circuit operable to output a detecting voltage from an output terminal connected to one end of the disconnection-detecting line, and to determine whether or not an input voltage fed back to an input terminal connected to the other end of the disconnection-detecting line as a result of the output of the detecting voltage is in an expected voltage relation with the detecting voltage; a latch circuit operable to latch a result of the determination by the determination circuit; an abnormality counter operable to count up periods for which results of the determination latched by the latch circuit in a row represent that the input voltage is out of the expected voltage relation, and arranged so that its count value is initialized in case that a result of the determination represents that the input voltage is in the expected voltage relation; and a timing controller operable to shift-control a latch timing of the latch circuit to latch in each predetermined cycle of the synchronizing signals with a predetermined shift.

According to such an arrangement, cross talk noise due to drive signals output by the driver IC in synchronization with synchronizing signals is produced on the disconnection-detecting line. On condition that the noise is superposed on an input voltage fed back as a result of output of a detecting voltage by the driver IC, the driver IC has a risk of falsely detecting the disconnection of the disconnection-detecting line (including not only a total disconnection, but also high-resistance connection attributed to partial rupture). In such a case, the driver IC brings about the same effect and advantage as those offered by the item [1] above. Therefore, the false detection of disconnection can be avoided readily and automatically. On this account, this configuration can contribute to the improvement of reliability of a before-shipment test or the like, which is arranged so that in a manufacturing process including an assembly, determination on whether or not disconnection is caused in a disconnection-detecting line of a driven device is accurately performed and in the event of disconnection, a crack or the like is regarded as being formed in the driven device. It is obvious that the detection of disconnection on a driven device can be applied to not only a before-shipment test, but also an early detection of the aging of a product or system with the driver IC incorporated therein.

[10] Allowable Voltage $\Delta V$

In the item [9] above, the expected voltage relation is one in which an absolute value voltage of difference between the detecting voltage and the input voltage is within an allowable voltage; and the determination circuit determines, based on allowable voltage data overwritably set on a memory circuit, whether or not the input voltage is in the expected voltage relation with the detecting voltage.

Such an arrangement brings about the same effect and advantage as those offered by the item [2] above.

[11] Unit Shift $\Delta t$

In the item [9] above, the timing controller determines a predetermined shift of the shift control based on unit shift data overwritably set on the memory circuit.

Such an arrangement brings about the same effect and advantage as those offered by the item [3] above.

[12] Latch Offset t1

In the item [9] above, the timing controller determines a first latch timing of latching, by the latch circuit, a result of determination by the determination circuit according to latch offset data overwritably set on the memory circuit.

Such an arrangement brings about the same effect and advantage as those offered by the item [4] above.

[13] Limit Value N

In the item [9] above, the abnormality counter outputs an abnormality signal on its count value reaching a value of limit value data overwritably set on the memory circuit.

Such an arrangement brings about the same effect and advantage as those offered by the item [5] above.

[14] Number n of Shifts

In the item [9] above, the timing controller has a synchronization counter operable to count up changes in synchronization with the synchronizing signals; and a subsequent latch timing of the latch circuit is restored to its initial timing on condition that the number of synchronizations counted up by the synchronization counter coincides with a number indicated by number-of-synchronizations data overwritably set on the memory circuit.

Such an arrangement brings about the same effect and advantage as those offered by the item [6] above.

[15] Counting of Count Pulses in Synchronization with the Latch Timing of the Latch Circuit In the item [9] above, the abnormality counter counts up count pulses on condition that the result of the determination represents that the input voltage is out of the expected voltage relation. The count pulses are signals subjected to pulse change in synchronization with the latch timing of the latch circuit. The timing controller outputs the count pulses.

Such an arrangement brings about the same effect and advantage as those offered by the item [7] above. [16] Control for shifting the latch timing in each cycle of synchronizing signals In the item [15] above, the timing controller performs shift control of the latch timing in each cycle of the synchronizing signals.

[17] LC Display Panel Module with Chip-on-Glass (COG)-Mounted Driver IC

In the item [9] above, the electronic apparatus is an LC display panel module, the driven device is an LC display panel formed on a glass substrate; the disconnection-detecting line is formed on an edge portion of the glass substrate, and the driver IC is mounted on the glass substrate in COG form.

According to such an arrangement, it is possible to determine whether or not a glass substrate of an LC display panel module is cracked.

[18] LC display panel module having an LC driver IC formed on a glass substrate

In the item [9] above, the electronic apparatus is an LC display panel module, the driven device is an LC display panel formed on a glass substrate, the disconnection-detecting line is formed on an edge portion of the glass substrate, and the driver IC is formed on the glass substrate with low-temperature polycrystalline silicon TFTs.

According to such an arrangement, it is possible to determine whether or not a glass substrate of an LC display panel module is cracked.

The effect achieved by the representative embodiment of the invention disclosed in the present application will be briefly outlined below.

It is possible to readily prevent disconnection from being falsely determined even on condition that an input voltage fed back as a result of output of a detecting voltage by a driver IC is affected by noise on a driven device.

Figure 2:
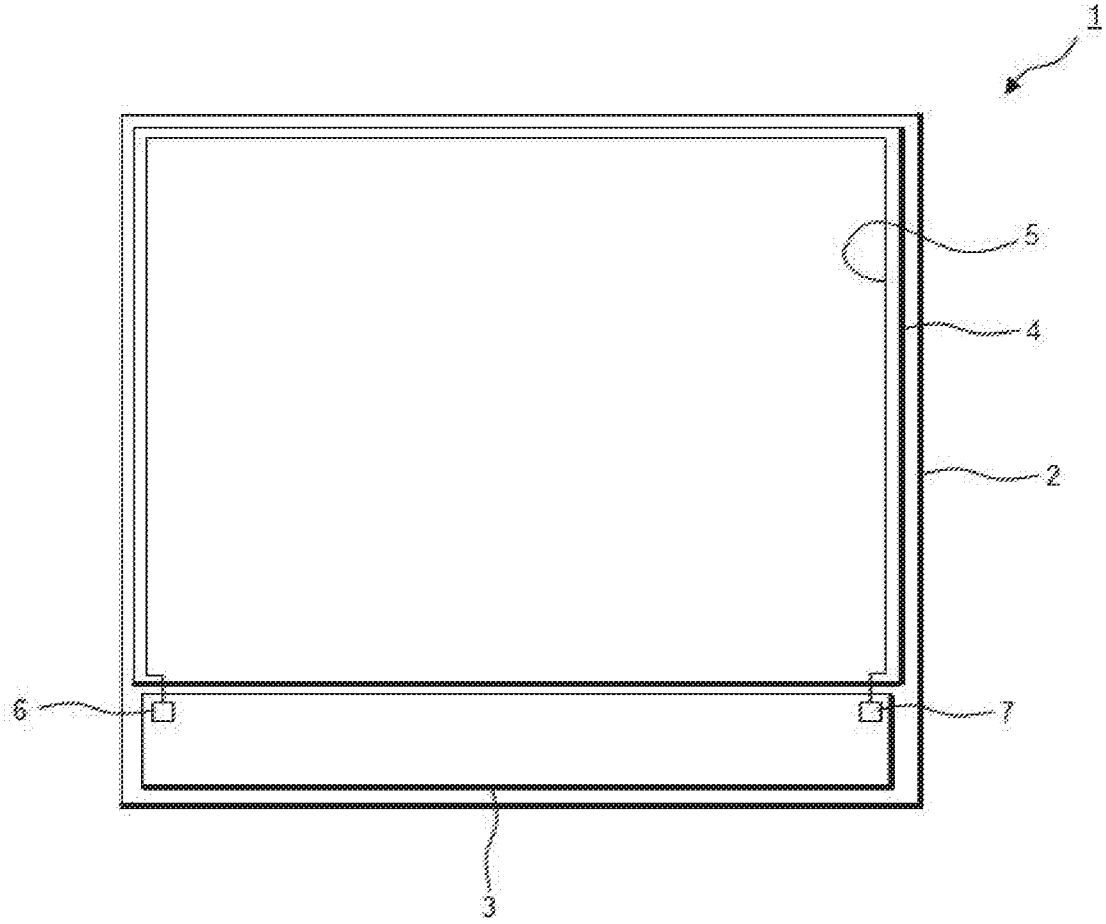
FIG. 2 is a schematic explanatory diagram showing, by example, an LC display panel module, which is an embodiment of an electronic apparatus.

FIG. 2 shows, by example, an LC display panel module that is an embodiment of an electronic apparatus. The LC display panel module 1 has an LC display panel 4 that is an embodiment of a driven device, and a display driver 3 that is an embodiment of a driver IC. The LC display panel 4 is formed on a glass substrate 2, for example. On the glass substrate 2, many wiring lines including gate and source lines of the LC panel and its reference potential line are formed. The display driver 3 is mounted in the form of a bare chip on the glass substrate, and is connected to corresponding wiring lines on the glass substrate, which is referred to as so-called "COG(Chip On Glass)" mounting. The form of mounting the display driver is not limited to the above. It may be SOG (System On Glass) form based on a polycrystalline silicon TFT (Thin Film Transistor) structure. In the case of SOG form, the LC driver 3 is formed on the glass substrate 2 with low-temperature polycrystalline silicon TFTs. In any case of so-called COG and SOG, a disconnection-detecting line 5 is formed, by a predetermined metal wiring pattern, on an edge portion of the glass substrate 2.

While not particularly shown in the diagram, the LC display panel 4 has, on the glass substrate 2, gate electrode lines and source electrode lines arranged to intersect with each other, where pixels are arranged like a matrix. Each pixel has a thin-film transistor and a liquid crystal element which are connected in series. The liquid crystal element of each pixel is provided with a common potential, and the thin-film transistor has a select terminal connected to a corresponding gate electrode line. The thin-film transistor has a signal terminal connected to a corresponding source electrode line arranged in a direction to intersect with the gate electrode line. A line of pixels associated with each gate electrode line is made a display line. The display lines are selected (display line scan) in such a way that the thin-film transistors of pixels are turned on in display lines. Gradation voltages are applied to liquid crystal elements through the source electrode lines in each display line select period (horizontal display period).

The display driver 4 produces and outputs drive signals on the gate electrode lines, gradation signals on the source electrode lines and signals including a common potential, and it has an output terminal 6 and an input terminal 7 for detection of disconnection. One end of a disconnection-detecting line 5 is connected to the output terminal 6, and the other end of the line 5 is connected to the input terminal 7.

Figure 3:
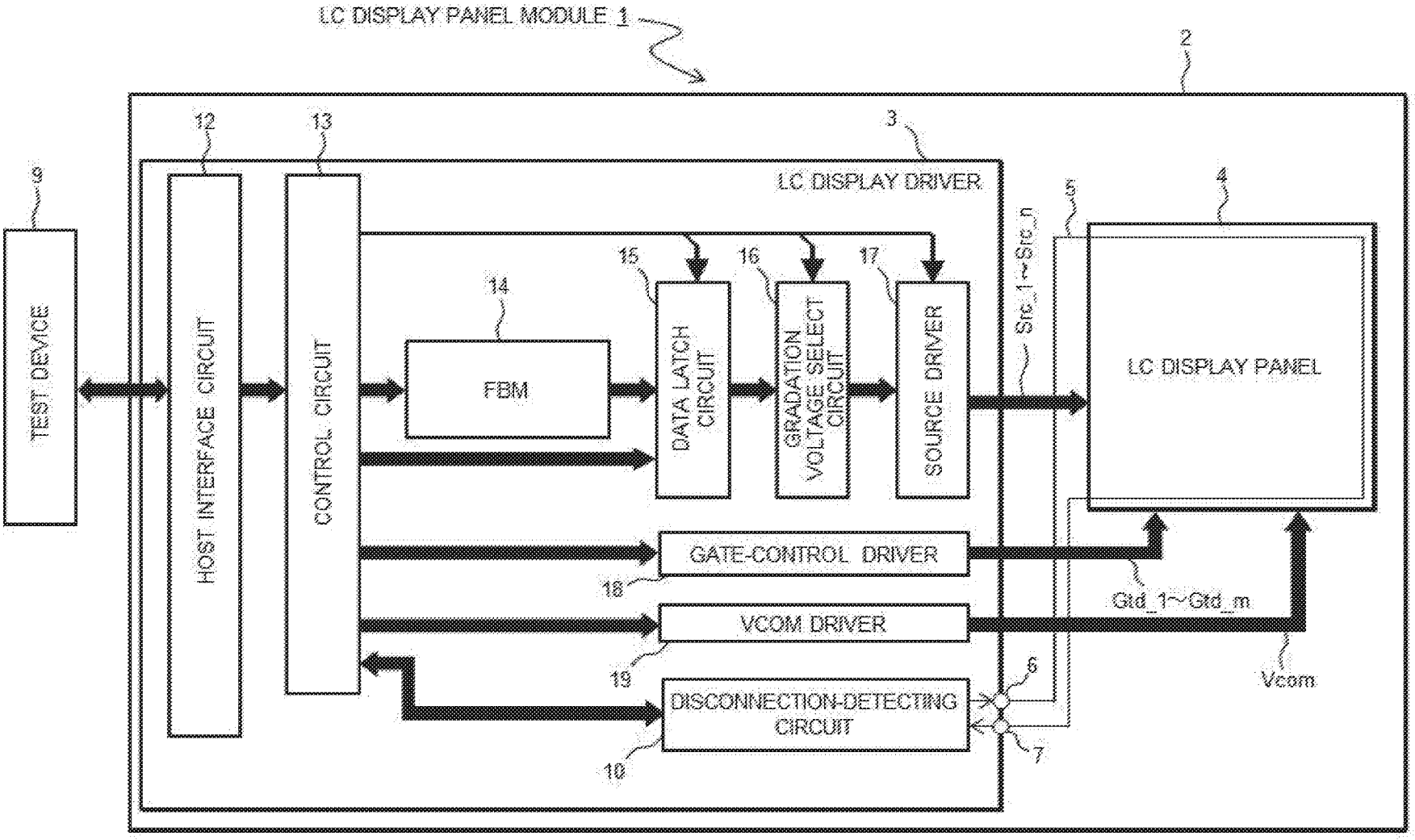
FIG. 3 is a block diagram showing an embodiment of an LC display driver.

FIG. 3 shows a specific embodiment of the LC display driver. The LC display driver 3 has a host interface circuit 12 that accepts the input of display data from the outside and outputs control data and accepts the input of control data. Assuming the execution of a before-shipment test in the manufacturing process of the LC display panel module 1, a test device 9 is connected to the host interface circuit 12 in this embodiment. On the other hand, in the case of a product arranged by incorporating the LC display panel module 1 in PC, a mobile terminal or the like, a host device such as a microcomputer or a data processor is connected to the host interface circuit 12. Display data and control data input to the host interface circuit 12 are processed by the control circuit 13. The control circuit 13 decrypts control data input thereto to decide an internal operation mode, and performs display drive control in synchronization with display timing signals supplied from the host interface circuit 12 or display timing signals generated in itself. The LC display driver has, as internal circuits used for the drive control, a frame buffer memory (FBM) 14, a data latch circuit 15, a gradation voltage select circuit 16, a source driver 17, a gate-control driver 18, and a VCOM driver 19. On condition that display data are input to the host interface circuit 12 together with display timing signals (vertical synchronizing signals and horizontal synchronizing signals) in real-time sequence, the control circuit 13 has the data latch circuit 15 latch the display data in display lines in synchronization with the display timing signals. Then, the gradation voltage select circuit 16 selects gradation voltages based on the data thus latched in display lines, and the source driver 17 receives the selected gradation voltages and drives source electrode lines Src_1 to Src_n. The gate-control driver 18 sequentially selects gate electrode lines Gtdn_1 to Gtd_m in each horizontal synchronization period. The VCOM driver 19 outputs a common potential Vcom. On condition that display data are supplied to the host interface circuit 12 together with a command, the display data are stored in the frame buffer memory 14 once and then, the display data thus stored are read in display lines into the data latch circuit 15 in each horizontal synchronization period of horizontal synchronizing signals produced in the control circuit 13. According to the data thus latched in display lines, the gradation voltage select circuit 16 selects gradation voltages, and the source driver 17 receives the gradation voltages and drives the source electrode lines Src_1-Src_n. The gate-control driver 18 sequentially selects the gate electrode lines Gtdn_1 to Gtdn_m in each horizontal synchronization period. The common potential Vcom is output by the VCOM driver 19.

The LC display driver 3 has a disconnection-detecting circuit 10 for detecting a disconnection in a disconnection-detecting line 5 in the LC display panel 4. In parallel with a display control action in a test mode, the disconnection-detecting circuit determines whether or not disconnection is caused in the disconnection-detecting line 5 connected to the output terminal 6 and the input terminal 7 for the detection of disconnection. The control data required for detection of disconnection and synchronizing signals are provided through the control circuit 13 from the test device 9 or the like. A result of the determination about disconnection is returned to the test device 9 through the control circuit 13.

In the event of disconnection, the test device 9 can regard the glass substrate 2 of the LC display panel module 1 as being cracked.

FIG. 1 shows an embodiment of the disconnection-detecting circuit 10. The disconnection-detecting circuit 10 has a determination circuit 21 that outputs a detecting voltage Vd1 from the output terminal 6, and determines whether or not an input voltage Vd2 fed back to the input terminal 7 as a result of the output is in an expected voltage relation with the detecting voltage Vd1. The determination circuit 21 includes comparators 22A and 22B and a logical OR gate 23, which are arranged by use of operational amplifiers. The detecting voltage Vd1 is produced by a detection voltage-producing circuit 20 such as a voltage regulator. Although no special restriction is intended, a falling drive pulse that falls from High level and a rising drive pulse which rises from Low level in contrast therewith are both assumed to be drive signals that would provide cross talk noise to the disconnection-detecting line 5 in this embodiment. Those pulses are alternately switched in e.g. frame synchronization in which synchronization is made with vertical synchronizing signals. The comparator 22A accepts the input of the detecting voltage Vd1 at a non-inverting input terminal (+), and the input voltage Vd2 at an inverting input terminal (−). The comparator 22B accepts the input of the detecting voltage Vd1 at an inverting input terminal (−), and the input voltage Vd2 at a non-inverting input terminal (+). With the comparator 22A, the expected voltage relation is $Vd1-Vd2<\Delta V$, where ΔV is an allowable voltage of fluctuation that the input voltage Vd2 is allowed to make. Likewise, in the comparator 22B, the expected voltage relation is $Vd2-Vd1<\Delta V$, where ΔV represents an allowable voltage of fluctuation that the input voltage Vd2 is allowed to make. Therefore, the result CMPOUT of the determination is made Low level (a logical value of 0) as long as the expected voltage relation that satisfies $|Vd1-Vd2|<\Delta V$ is achieved, whereas the result CMPOUT of the determination is made High level (a logical value of 1) in case that the expected voltage relation is not achieved ($|Vd1-Vd2|\geq\Delta V$). The allowable voltage ΔV is decided based on allowable voltage data DΔV overwritably set on the register 27A. The allowable voltage ΔV works on the comparator 22A as an offset ($Vd1-\Delta V$) on the inverting input terminal (−) side, and works on the comparator 22B as an offset ($Vd1+\Delta V$) on the non-inverting input terminal (+) side. The comparator 22A is a circuit for making comparison of a potential difference on condition that the input voltage Vd2 is made lower than the detecting voltage Vd1 by e.g. the rise in impedance of the disconnection-detecting line 5 caused by a disconnection. The comparator 22B is a circuit for making comparison of a potential difference on condition that the input voltage Vd2 is made higher than the detecting voltage Vd1 by e.g. the short circuit of the disconnection-detecting line 5 with another line caused by a broken glass substrate. In any of cases where cross talk noise makes the input potential Vd2 higher than the detecting voltage Vd1 and it makes the input potential Vd2 lower than the detecting voltage Vd1, the outputs of the comparators 22A and 22B will change in the same way.

The result CMPOUT of the determination by the determination circuit 21 is latched by the latch circuit 24. A latch signal FFOUT of the latch circuit 24 that has latched the determination result is provided to the abnormality counter 25. The abnormality counter 25 counts clocks CNTCLK according to the value of the latch signal FFOUT. The abnormality counter 25 counts clocks CNTCLK in a high-level duration in which the latch signal latched by the latch circuit 24 is continuously out of relation the expected voltage relation. The abnormality counter initializes its count value to zero (0) at the time when the determination result goes into the expected voltage relation. Further, the abnormality counter outputs an abnormality signal FLTd at the time when its count value reaches a limit value N. The limit number N is decided based on limit value data DN overwritably set on the register 27C.

The timing controller 26 produces latch clocks FFCLK of the latch circuit 24 and the count clocks CNTCLK. The timing controller 26 performs shift control of the latch timing of the latch circuit 24 depending on the latch clocks FFCLK with a predetermined unit shift Δt in each predetermined cycle of horizontal synchronizing signals HSYNC, e.g. each monocycle, whereby the latch timing of the latch circuit 24 in a horizontal synchronization period is changed by the unit shift Δt from one horizontal synchronization period to another sequentially until the count value reaches the limit value N. The unit shift Δt is decided based on the unit shift data DΔt overwritably set on the register 27B.

Further, the timing controller 26 causes the pulse change in the count pulses CNTCLK in synchronization with the latch timing of the latch circuit 24. The number of count pulses represents the number of times the expected voltage relation has not been achieved successively. Therefore, the fact that the expected voltage relation has not been achieved N times in a row means that the determination about disconnection has been executed with mutually different timings in N horizontal synchronization periods respectively and the results thereof are all disconnection in a row and therefore. This means that there is a higher risk of disconnection being caused in view of probability. This is on the assumption that the drive timing of each display line and other drive timings each have a bias within a horizontal synchronization period in terms of time, and drive signals are not produced in the same way anywhere in horizontal synchronization periods. Therefore, the larger the limit number N of times is, and the smaller the latch timing shift amount Δt is, the higher level of reliability the result of the determination is allowed to have.

Further, the timing controller 26 uses, as controlled variables for defining the latch timing, a latch offset t1 and a number n of synchronizations for defining the number of shifts in addition to the unit shift Δt. The latch offset t1 is a controlled variable that decides the first latch timing for making the latch circuit 24 latch the result of the determination by the determination circuit 21. The latch offset t1 is decided based on latch offset data Dt1 overwritably set on the register 27B. The number n of synchronizations is a controlled variable for restoring the subsequent latch timing of the latch circuit 24 to its initial timing. The number n of synchronizations is decided based on number-of-synchronizations data Dn overwritably set on the register 27B. The timing controller 26 counts up horizontal synchronization periods based on changes in horizontal synchronizing signals HSYNC, and restores the latch timing of the latch circuit 24 to its initial timing on the count value reaching the number n of synchronizations. In this way, the action of repeating, in a wrap around manner, a round of the action of shifting the latch timing of the latch circuit 24 at intervals of more than one cycle of horizontal synchronizing signals HSYNC is readily materialized.

Figure 4:
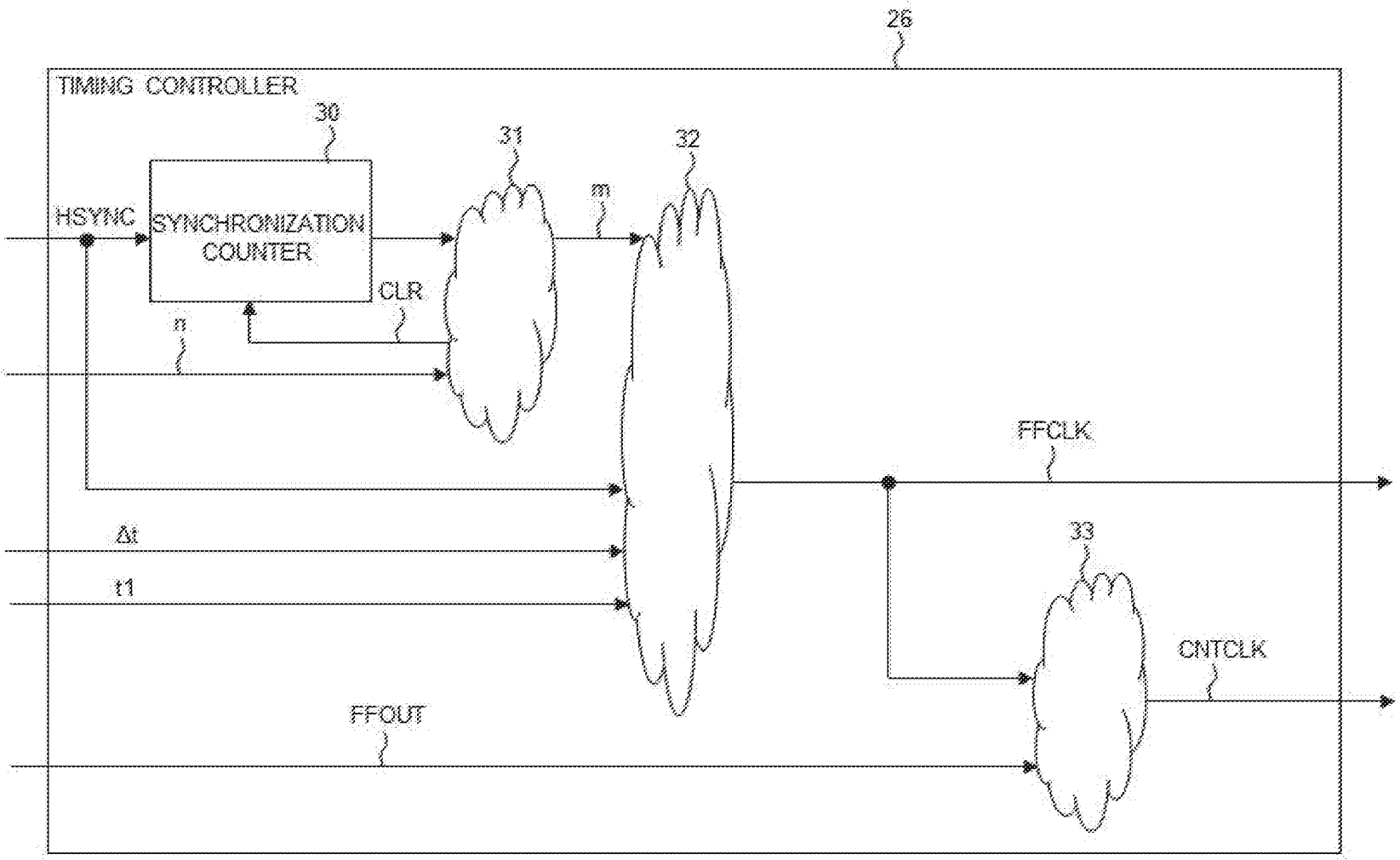
FIG. 4 is a block diagram showing an embodiment of a timing controller.

FIG. 4 presents a block diagram showing, by example, the timing controller 26. The synchronization counter 30 counts up horizontal synchronizing signals HSYNC. Its resultant count value and number-of-synchronizations data Dn are input to the logic circuit 31. The logic circuit 31 initializes, by clear signal CLR, the count value of the synchronization counter 30 to its initial value of zero (0) each time the count value reaches the number n of synchronizations. The logic circuit 32 accepts the input of a count value m of the synchronization counter 30, horizontal synchronizing signals HSYNC, a unit shift data DΔt, and latch offset data Dt1, and then, produces the latch clocks FFCLK. The logic circuit 33 accepts the input of latch clocks FFCLK and latch signals FFOUT and produces the count clocks CNTCLK.

The unit shift data DΔt, latch offset data t1, number-of-synchronizations data Dn, limit value data DN, and allowable voltage data DΔV which define various controlled variables for detection of disconnection are provided from the test device 9 to the control circuit 13 through the host interface 12 in the test mode. The control data thus provided may be directly loaded into the registers 27, 28 and 29, or they may be once stored in a non-volatile memory circuit, which is not shown in the diagram, and then loaded therein. In case that no optimal controlled variable is decided in the first test operation, it is adequate to repeatedly perform the operation for detection of disconnection while appropriately overwriting the controlled variables. In tests on like LC panel modules, controlled variables decided once may be used to perform the tests for detection of disconnection. In application to detection of disconnection owing to the aging after product shipment, the controlled variables decided once may be stored in a nonvolatile memory device in the control circuit 13 and then, they may be first appropriately loaded into the registers 27A, 27B and 27C for use. The registers 27A, 27B and 27C form an embodiment of the memory circuit 27. The memory circuit 27 maybe configured with SRAM or the like.

Figure 5:
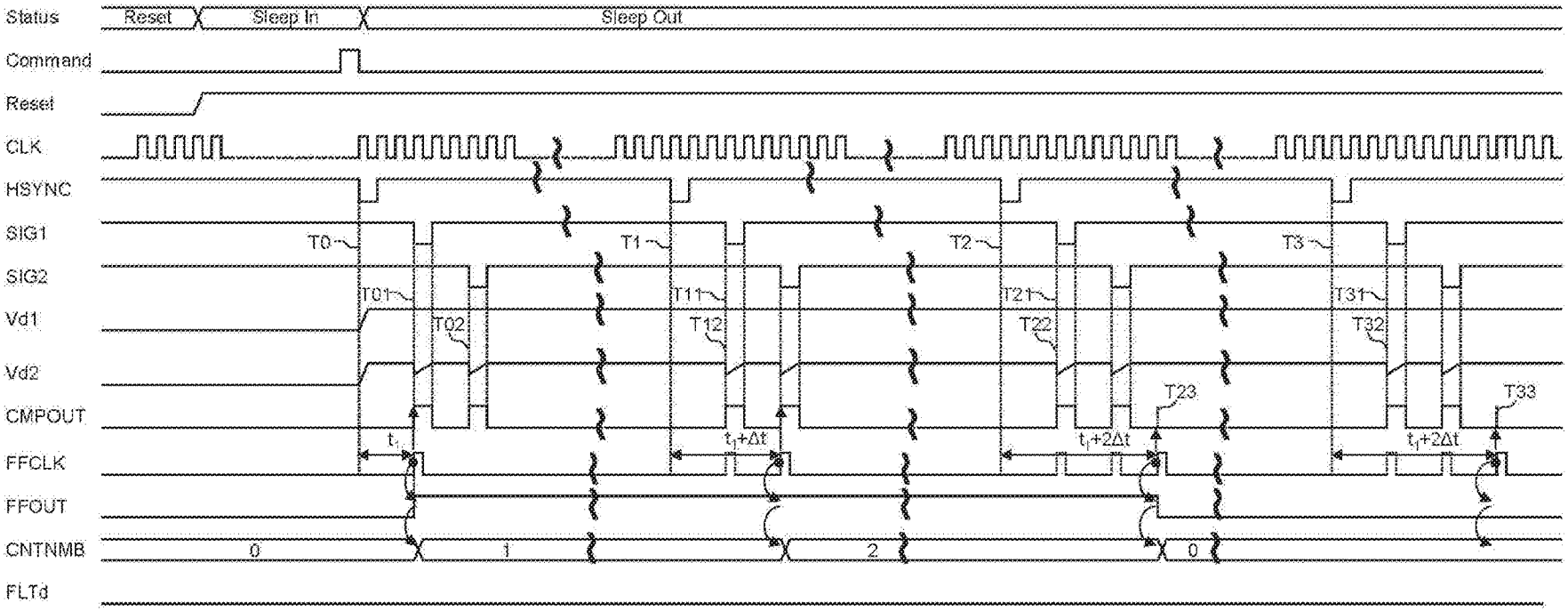
FIG. 5 is a timing chart showing, by example, an operation timing of the disconnection-detecting circuit.

FIG. 5 shows, by example, the timing of the operation of the disconnection-detecting circuit. In this example, the LC display driver 3 is put in a sleep state after reset and then it is brought into action on the acceptance of input of a sleep-cancel command. Drive signals provided to the LC display panel 4 are shown by signals SIG1 and SIG2 representatively. The drive signals SIG1 and SIG2 are subjected to the falling pulse change in line with the drive timing and thus cross talk noise, which causes the input signal Vd2 to undesirably decline in its level, is superposed on the input signal Vd2. Before the time T0 where the first horizontal synchronization period starts, the count value of the abnormality counter 25 and that of the synchronization counter 30 are both an initial value of zero (m=0).

In the horizontal synchronization period starting from the time T0, the synchronization counter 30 is incremented from zero to one (m=1). The input voltage Vd2 is fallen in line with the time T01 and T02 with the noise remaining superposed thereon. The noise is larger than the allowable voltage ΔV and as such, during a duration of the noise the determination result CMPOUT is made High level according to the duration of the noise. In this period, a latch offset t1 overlaps with the first part of the duration of the noise. The latch signal FFOUT is inverted into High level in synchronization with the pulse change in the latch clock FFCLK at the time (Δt×(m−1)+t1) after the elapse of the latch offset t1 from the time T0. Thus, the count value of the abnormality counter 25 is incremented from zero to one.

In the subsequent horizontal synchronization period starting from the time T1, the synchronization counter 30 is incremented from one to two (m=2). The input voltage Vd2 is fallen in line with the time T11 and T12 with the noise remaining superposed thereon in the same way as described above. The noise is larger than the allowable voltage ΔV and as such, the determination result CMPOUT is made High level according to the duration of the noise. In this period, the latch offset t1 overlaps with the first part of the duration of the noise as in above and further, a length of time of the latch offset t1 plus the unit shift Δt overlaps with the subsequent duration of the noise. The latch clocks FFCLK is subjected to the pulse change at the time (Δt×(2−1)+t1) after the elapse of the length of time of the latch offset t1 plus the unit shift Δt from the time T1 and in synchronization with this, the latch signal FFOUT is kept at High level. Thus, the count value of the abnormality counter 25 is incremented from one to two. In this embodiment, the limit number N of times is three or more and therefore, the abnormality signal FLTd is not activated even if the count value of the abnormality counter 25 becomes two.

In the subsequent horizontal synchronization period starting from the time T2, the synchronization counter 30 is incremented from two to three (m=3). The input voltage Vd2 is fallen in line with the time T21 and T22 with the noise remaining superposed thereon in the same way as described above. The noise is larger than the allowable voltage ΔV and as such, the determination result CMPOUT is made High level according to the duration of the noise. In this period, the latch offset t1 overlaps with the first part of the duration of the noise as in the above and further, a length of time of the latch offset t1 plus the unit shift Δt overlaps with the subsequent duration of the noise. The latch clock FFCLK is subjected to the pulse change at the time (Δt×(3−1)+t1) (e.g. the time T23) after the elapse of a length of time of the latch offset t1 plus a length of time twice the unit shift Δt from the time T2 and in synchronization with this, the latch signal FFOUT is inverted into Low level. Thus, the count value of the abnormality counter 25 is cleared from two to zero.

Figure 6:
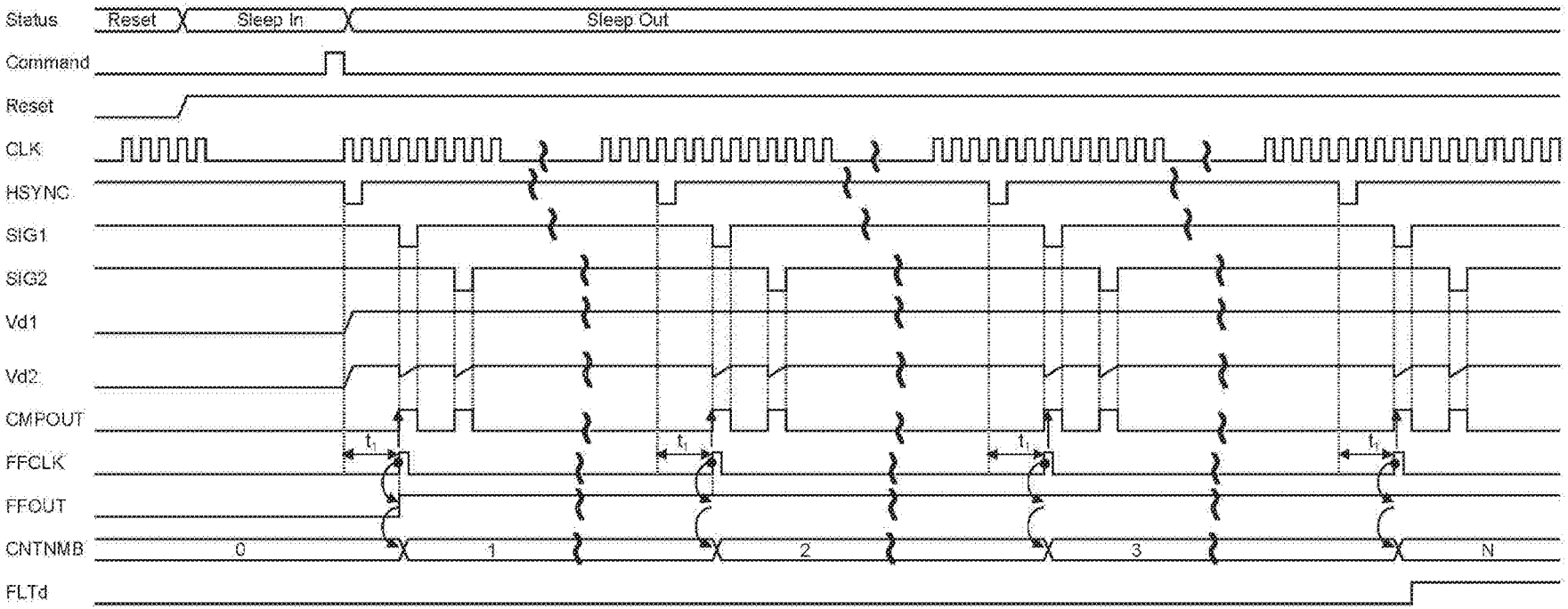
FIG. 6 is a timing chart showing, as a comparative example, the timing of an operation for detecting a disconnection without sequentially shifting a latch timing.

The embodiment shown in FIG. 5 is on the assumption that noise is generated twice in the first half of each horizontal synchronization period. So, in subsequent horizontal synchronization periods since the time T3, the latch signal FFOUT is kept at Low level, and the count value of the abnormality counter 25 remains zero. This state is retained until the value of the synchronization counter 30 reaches the number n of synchronizations. Since the time T3, the same operations as those described above are repeated. Therefore, disconnection can be prevented from being false determined under the influence of noise. While not particularly shown in the diagram, the latch signal FFOUT is made High level constantly in the event of an actual disconnection. Consequently, the abnormality signal FLTd is activated by increasing the count value of the abnormality counter 25 to over the limit value N and then, disconnection in the disconnection-detecting line 5 is notified. While FIG. 6 shows the operation timing for detection of the disconnection in the case of not sequentially shifting the latch timing as a comparative example. In that case, the latch timing of the latch circuit is fixed after the time t1 from the start of the horizontal synchronization period and therefore, the latch signal FFOUT always remains at High level. Consequently, the count value of the abnormality counter 25 will exceed the limit value N. Then, the abnormality signal FLTd is activated and thus, the detection of disconnection is notified incorrectly.

Figure 7:
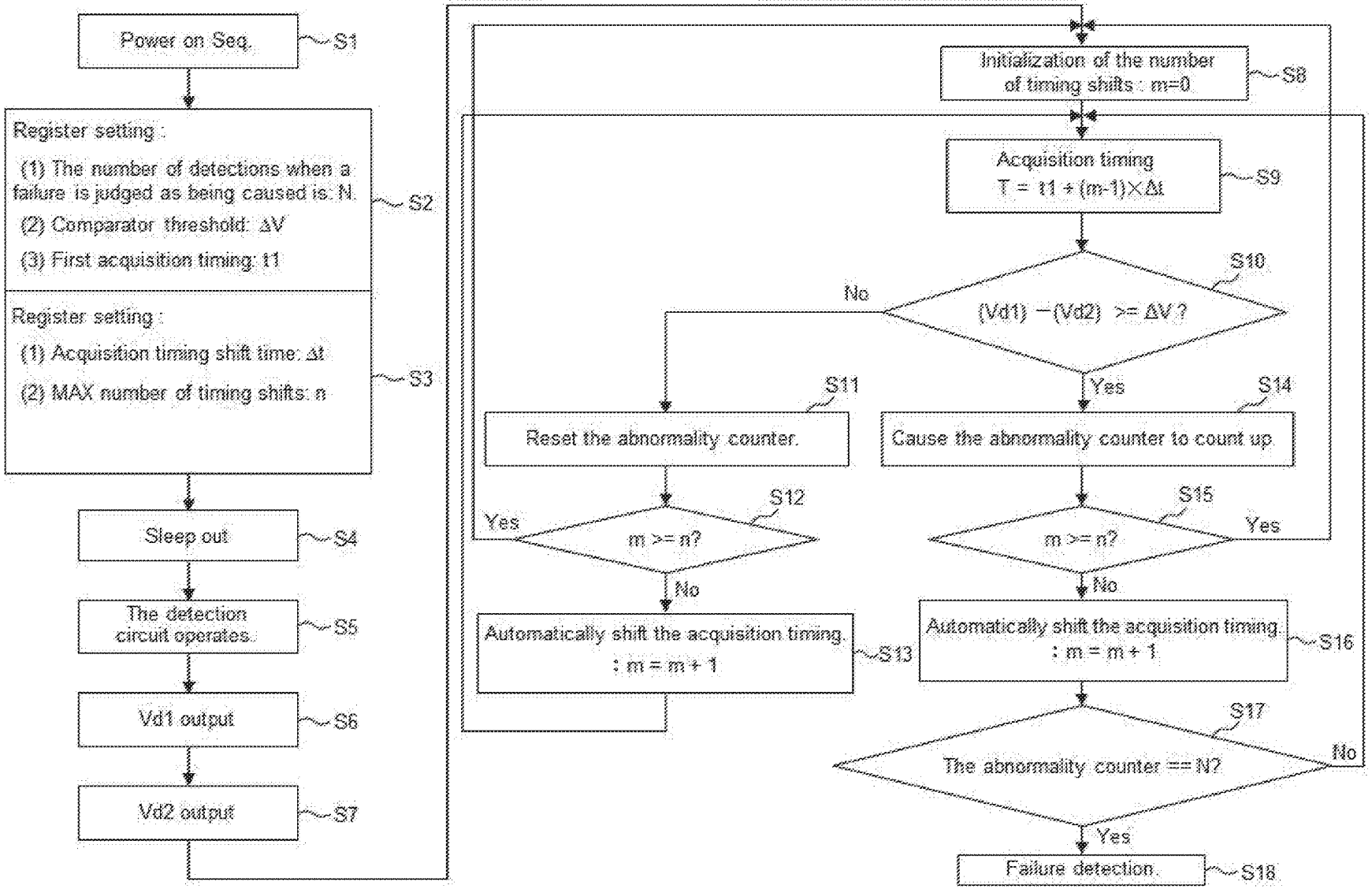
FIG. 7 is a flow chart showing, by example, a flow of the operation for detecting a disconnection.

FIG. 7 shows, by example, the flow of the operation for detection of disconnection. On the power-on, a predetermined power-on sequence is performed (S1). Then, the initial setting is performed on the register circuit 27 (S2, S3), in which the unit shift Δt, the latch offset t1, the number n of synchronizations, the limit value N, and the allowable voltage ΔV are decided. After that, the display action by the display driver 3 is started (S4) and in parallel, the action of the disconnection-detecting circuit 10 is started (S5).

First, the detecting voltage Vd1 is output (S6), and then the input voltage Vd2 is input (S7). While keeping this state, the following actions are performed. First, the number of timing shifts, namely the number of synchronizations of the synchronization counter 30 is set to an initial value m=0 (S8). The logic circuit 32 calculates, by use of the number m of synchronizations, the unit shift Δt, and the latch offset t1, the acquisition timing T=t1+(m−1)×Δt in synchronization with horizontal synchronizing signals HSYNC, and produces latch clocks FFCLK according thereto (S9). The processing is selected depending on whether or not latch data fits the abnormal relation |Vd1−Vd2|≥ΔV (S10). If the data does not fit the abnormal relation, the count value of the abnormality counter 25 is initialized (S11). Then, if m≥n, the operation is returned to the step S8. Otherwise, if m≥n is not satisfied, the synchronization counter is incremented by +1 (m=m+1) (S13) and then, the operation is returned to the step S9. If the latch data fits the abnormal relation, the abnormality counter 25 is incremented by +1 (S14). Then, depending on the result of the determination about m≥n (S15), the operation is returned to the step S8, or the synchronization counter 30 is incremented by +1 (m=m+1) (S16), followed by the determination on whether or not the value of the abnormality counter 25 has reached the limit value N (S17). If the value has not reached the limit value N, the operation is returned to the step S9. If the value has reached the limit value N, the abnormality signal FLTd is activated (S18).

While the invention made by the inventor(s) have been concretely described based on the embodiments, the invention is not limited to the embodiments. Various changes or modifications may be made without departing from the subject matter thereof.

For instance, the driver IC is not limited to an LC display driver, but can be applied to drivers for display drive of other display panels and further, to other appropriate driver ICs. In addition, the various kinds of control data are not limited to the case in which all of the unit shift At, the latch offset t1, the number n of synchronizations, the limit value N, and the allowable voltage ΔV are used, but only one or more of them may be used as needed. In addition, appropriately using other control data is unimpeded. Further, the disconnection-detecting circuit may be arranged so that it is directly connected to a test interface circuit which can be used in a test mode and controlled by a test device. The driver IC is not limited to a single-function driver such as an LC display driver. For instance, it may be mounted together with a touch panel controller, or mounted in On-chip form as a peripheral circuit to a microcomputer.

In the above embodiments, two comparators 22A and 22B are adopted; the comparator 22A serves to make comparison of a potential difference on condition that the input voltage Vd2 is made lower than the detecting voltage Vd1 by e.g. the rise in impedance of the disconnection-detecting line 5 owing to disconnection, and the comparator 22B serves to make comparison of a potential difference on condition that the input voltage Vd2 is made higher than the detecting voltage Vd1 by e.g. the short circuit of the disconnection-detecting line 5 with another line owing to the broken glass substrate. However, the invention is not limited to the embodiments, and the determination circuit may be arranged to include only the comparator 22A.

What is claimed is:

1. A driver integrated circuit (IC), comprising:

driving circuits operable to periodically output drive signals to a drivable device in synchronization with synchronizing signals; and a detection circuit configured to detect a disconnection in the drivable device, wherein the detection circuit includes:

a determination circuit comprising:

a first comparator having a non-inverting input terminal configured to receive a detecting voltage from an output terminal and an inverting input terminal configured to receive an input voltage fed back to an input terminal;

a second comparator having a non-inverting input terminal configured to receive the input voltage and an inverting input terminal configured to receive the detecting voltage; and a logic unit coupled to the output of the first comparator and the second comparator and configured to output a determination signal indicating whether the input voltage is in an expected voltage relation corresponding to an absolute value of a difference between the detecting voltage and the input voltage;

a latch circuit coupled to an output of the determination circuit and configured to latch the determination signal;

an abnormality counter coupled to an output of the latch circuit and configured to count up periods for which the determination signal latched by the latch circuit in a row represent that the input voltage is out of the expected voltage relation, wherein a count value of the abnormality counter is initialized based at least in part on a determination that the input voltage is in the expected voltage relation; and a timing controller coupled to an input of the abnormality counter and an input of the latch circuit and configured to shift-control a latch timing of the latch circuit to latch in one or more cycles of the synchronizing signals with a first shift.

2. The driver IC according to claim 1, wherein the timing controller is further configured to determine the first shift of the shift-control based on unit shift data overwritably set on a memory circuit.

3. The driver IC according to claim 1, wherein the timing controller is further configured to determine a first latch timing of latching, by the latch circuit, a result of determination by the determination circuit according to latch offset data overwritably set on a memory circuit.

4. The driver IC according to claim 1, wherein the abnormality counter is further configured to output an abnormality signal at least partially based on the count value reaching a value of limit value data overwritably set on a memory circuit.

5. The driver IC according to claim 1, wherein the timing controller has a synchronization counter configured to count changes in synchronization with the synchronizing signals, and a subsequent latch timing of the latch circuit is restored to an initial timing at least partially based on a number of synchronizations counted by the synchronization counter coinciding with a number indicated by number-of-synchronizations data overwritably set on a memory circuit.

6. The driver IC according to claim 1, wherein the abnormality counter is configured to count pulses at least partially based on the determination signal representing that the input voltage is out of the expected voltage relation, the counted pulses are signals subjected to pulse change in synchronization with the latch timing of the latch circuit, and the timing controller is further configured to output the counted pulses.

7. The driver IC according to claim 1, wherein the timing controller is further configured to perform shift control of the latch timing in each cycle of the synchronizing signals.

8. An electronic apparatus, comprising:

a drivable device comprising a disconnection-detecting line; and a driver integrated circuit (IC) configured to drive the drivable device, the driver IC comprises:

driving circuits configured to periodically output drive signals to the drivable device in synchronization with synchronizing signals; and a detection circuit configured to detect disconnection in the disconnection-detecting line of the drivable device, the detection circuit comprises:

a determination circuit comprising:

a first comparator having a non-inverting input terminal configured to receive a detecting voltage from an output terminal connected to a first end of the disconnection-detecting line, and an inverting input terminal configured to receive an input voltage fed back to an input terminal connected to a second end of the disconnection-detection line;

a second comparator having a non-inverting input terminal configured to receive the input voltage and an inverting input terminal configured to receive the detecting voltage; and a logic unit circuit coupled to the output of the first comparator and the second comparator and configured to output a determination signal indicating whether the input voltage is in an expected voltage relation corresponding to an absolute value of a difference between the detecting voltage and the input voltage;

a latch circuit coupled to an output of the determination circuit and configured to latch the determination signal;

an abnormality counter coupled to an output of the latch circuit and configured to count periods for which the determination signal latched by the latch circuit in a row represent that the input voltage is out of the expected voltage relation, wherein a count value of the abnormality counter is initialized based at least in part on a determination that the input voltage is in the expected voltage relation; and a timing controller coupled to an input of the abnormality counter and an input of the latch circuit, and configured to shift-control a latch timing of the latch circuit to latch in one or more cycles of the synchronizing signals with a first shift.

9. The electronic apparatus according to claim 8, wherein the timing controller is further configured to determine the first shift of the shift-control based on unit shift data overwritably set on a memory circuit.

10. The electronic apparatus according to claim 8, wherein the timing controller is further configured to determine a first latch timing of latching, by the latch circuit, a result of the determination by the determination circuit according to latch offset data overwritably set on a memory circuit.

11. The electronic apparatus according to claim 8, wherein the abnormality counter is further configured to output an abnormality signal at least partially based on the count value reaching a value of limit value data overwritably set on a memory circuit.

12. The electronic apparatus according to claim 8, wherein the timing controller includes a synchronization counter configured to count changes in synchronization with the synchronizing signals, and a subsequent latch timing of the latch circuit is restored to an initial timing on at least partially based on a number of synchronizations counted by the synchronization counter coinciding with a number indicated by number-of-synchronizations data overwritably set on a memory circuit.

13. The electronic apparatus according to claim 8, wherein the abnormality counter is further configured to count pulses at least partially based on the determination signal representing that the input voltage is out of the expected voltage relation, the counted pulses are signals subjected to pulse change in synchronization with the latch timing of the latch circuit, and the timing controller is further configured to output the counted pulses.

14. The electronic apparatus according to claim 8, wherein the timing controller is further configured to perform shift control of the latch timing in each cycle of the synchronizing signals.

15. The electronic apparatus according to claim 8, wherein the drivable device is a liquid crystal (LC) display panel formed on a glass substrate, the disconnection-detecting line is formed on an edge portion of the glass substrate, and the driver IC is mounted on the glass substrate in chip-on-glass COG form.

16. The electronic apparatus according to claim 8, wherein the drivable device is a liquid crystal (LC) display panel formed on a glass substrate, the disconnection-detecting line is formed on an edge portion of the glass substrate, and the driver IC is formed on the glass substrate with low-temperature polycrystalline silicon thin-film-transistors (TFTs).

17. The electronic apparatus according to claim 8, wherein the expected voltage relation is one in which an absolute value voltage of difference between the detecting voltage and the input voltage is within an allowable voltage, and the allowable voltage serves as an offset to the inverting input terminal on the first comparator, and serves as an offset to the non-inverting input terminal on the second comparator.

18. A method for detecting a disconnection in a drivable device, the method comprising:

determining, by a determination circuit, whether an input voltage fed back to an input terminal as a result of an output of a detecting voltage from an output terminal is in an expected voltage relation corresponding to an absolute value of a difference between the detecting voltage and the input voltage, wherein determining whether the input voltage fed back to the input terminal is in an expected voltage relation comprises:

receiving the detecting voltage at a non-inverting input terminal of a first comparator of the determination circuit and the input voltage at an inverting input terminal of the first comparator;

receiving the input voltage at a non-inverting input terminal of a second comparator of the determination circuit and the detecting voltage at an inverting input terminal of the second comparator; and outputting, from a logic unit circuit coupled to the output of the first comparator and the second comparator, a determination signal indicating whether the input voltage is in the expected voltage relation;

latching, by a latch circuit, a result of the determination whether the input voltage is in the expected voltage relation, wherein the latch circuit is coupled to an output of the determination circuit;

counting, by an abnormality counter, up periods for which results of the determination latched by the latch circuit in a row represent that the input voltage is out of the expected voltage relation, wherein a count value of the abnormality counter is initialized based at least in part on a determination that the input voltage is in the expected voltage relation, and wherein the abnormality counter is coupled to an output of the latch circuit; and controlling, by a timing controller, a latch timing of the latch circuit to latch in one or more cycles of synchronizing signals with a first shift, wherein the timing controller is coupled to an input of the abnormality counter and an input of the latch circuit.

19. The method of claim 18, further comprising:

determining, by the timing controller, the first shift based on unit shift data of a memory circuit; and determining, by the timing controller, a first latch timing of latching the result of the determination whether the input voltage is in the expected voltage relation according to latch offset data of the memory circuit.

20. The method of claim 18, further comprising:

counting, by the abnormality counter, pulses at least partially based on the result of the determination whether the input voltage is in the expected voltage relation, wherein the counted pulses are signals subjected to pulse change in synchronization with the latch timing.

* * * * *